US005384428A

United States Patent [19]

Luu

[11] Patent Number: 5,384,428

[45] Date of Patent: Jan. 24, 1995

[54] RECEPTACLE WALL PLATE WITH BUILT-IN PROTECTION CIRCUITRY

[75] Inventor: Lionel T. V. Luu, Hong Kong, Hong Kong

[73] Assignee: Pacusma Co. Ltd., Kowloon, Hong Kong

[21] Appl. No.: 995,737

[22] Filed: Dec. 22, 1992

[51] Int. Cl.[6] ..... H01R 13/453

[52] U.S. Cl. ..... 174/66; 361/118; 439/536

[58] Field of Search ..... 174/66; 220/241; 362/95; 439/536; 361/118

[56] References Cited

U.S. PATENT DOCUMENTS

| | | | |
|---|---|---|---|
| 2,385,620 | 9/1945 | Fleckenstein | 174/66 |
| 4,010,431 | 3/1977 | Virani | 335/18 |
| 4,798,916 | 1/1989 | Engel et al. | 174/67 |
| 4,872,081 | 10/1989 | Murphy et al. | 361/117 |
| 5,114,365 | 5/1992 | Thompson et al. | 174/66 X |

*Primary Examiner*—Leo P. Picard
*Assistant Examiner*—D. A. Tone
*Attorney, Agent, or Firm*—Ostrolenk, Faber, Gerb & Soffen

[57] ABSTRACT

A receptacle wall plate having built-in circuitry for protecting electrical devices. The wall plate has a face plate for receiving at least one plug of an electrical device, and an inner surface and rounded edges which extend toward the wall to form a hollow body. When a plug is inserted through the face plate, an electrical circuit mounted in the hollow body automatically connects to the plug and protects the electrical devices from surges or other dangerous electrical conditions. In addition, electricity is automatically supplied to the electrical circuit when the plug is inserted through the face plate.

3 Claims, 4 Drawing Sheets 40
10
14
15
13
11
12
18
50
60

RECEPTACLE WALL PLATE WITH BUILT-IN PROTECTION CIRCUITRY

BACKGROUND OF THE INVENTION

1. Field of the Invention

The present invention relates to an electrical receptacle wall plate having built-in protection circuitry, particularly surge protection circuitry.

2. Description of the Related Art

Modern electrical equipment typically contains complex electronic circuitry which is susceptible to damage from electrical surges, spikes and noises. In order to protect electrical equipment from these types of disturbances, devices such as power conditioners and surge suppressors have been developed.

Devices for protecting electrical equipment from surges are well known. Two categories of surge protection devices are available: hard-wired devices and plug-in devices. Hard-wired devices are installed in the home or building distribution box, junction box, or built into the wall outlet receptacle itself. As their name implies, hard-wired devices must be wired, typically by an electrician, into the building wire circuitry.

The second category of protection devices, plug-in devices, are usually provided in the form of power strips or adapters. Although these devices are easy to install—they are simply plugged into a wall outlet—they are also easily removed. In circumstances where the power strip is removed to be used elsewhere, and not replaced, the outlet loses its protection capability. Thus, a need exists for a permanent electrical protection device which can be easily installed in an existing wall outlet.

SUMMARY OF THE INVENTION

An object of the present invention is, therefore, to provide a receptacle wall plate having built-in protection circuitry, which can be easily installed. The receptacle wall plate of the invention, like any conventional wall plate, is attached to a wall outlet simply by one or two recessed screws.

The receptacle wall plate of the present invention appears and functions like any conventional wall plate. However, advantageously, when an electrical device is plugged into the receptacle wall plate, electrical power is automatically supplied to protection circuitry contained in the wall plate. Thus, the protection circuitry functions only when a plug of the electrical device is inserted into the receptacle. Since the protection circuitry is not electrically connected to the line voltage until a device is plugged in, it is as safe and simple to install as a conventional wall plate. Moreover, the protection device of the present invention is more power efficient and lasts longer, since it operates only when protection is needed.

Still another object of the invention is to provide a protection device which is slim in design and does not occupy existing wall outlet receptacles, as with conventional plug-in devices or outlet adapters.

A further object of the invention is to provide a protection device which incorporates other circuitry, such as a night light, an electrical circuit analyzer or an alarm, which can be connected to the protection circuitry.

Another object of the invention is to provide additional protection to other secondary devices, for example, telephones and televisions.

The receptacle wall plate of the present invention fulfills all of the above objectives. The wall plate has a planar face plate for receiving at least one plug of an electrical device. The face plate has an inner surface and rounded edges extending toward a surface of a wall on which the wall plate is mounted. The face plate and edges form a hollow body. An electrical circuit is mounted in the hollow body. When a plug of an electrical device is inserted through the face plate, the electrical circuit is automatically connected to the plug and protects the electrical device. Additionally, electricity is automatically supplied to the electrical circuit when the plug is inserted through the face plate.

Advantageously, the electrical circuit may be mounted on a printed circuit board disposed in the hollow body. The automatic coupling of the circuit to the plug and electrical power is preferably accomplished by a pair of contact blades mounted in the hollow body. When a device is plugged through a receptacle wall plate of the invention and into a wall outlet, the blades electrically couple the live and neutral prongs of the plug to the electrical protection circuitry, thus supplying electrical power thereto and supplying protection to the device.

The face plate may optionally include a jack or connectors for connecting other secondary devices to protect these other secondary devices from electrical surges.

Other features and advantages of the present invention will become apparent from the following description of the invention which refers to the accompanying drawings.

DETAILED DESCRIPTION OF THE PREFERRED EMBODIMENTS

Figure 1:
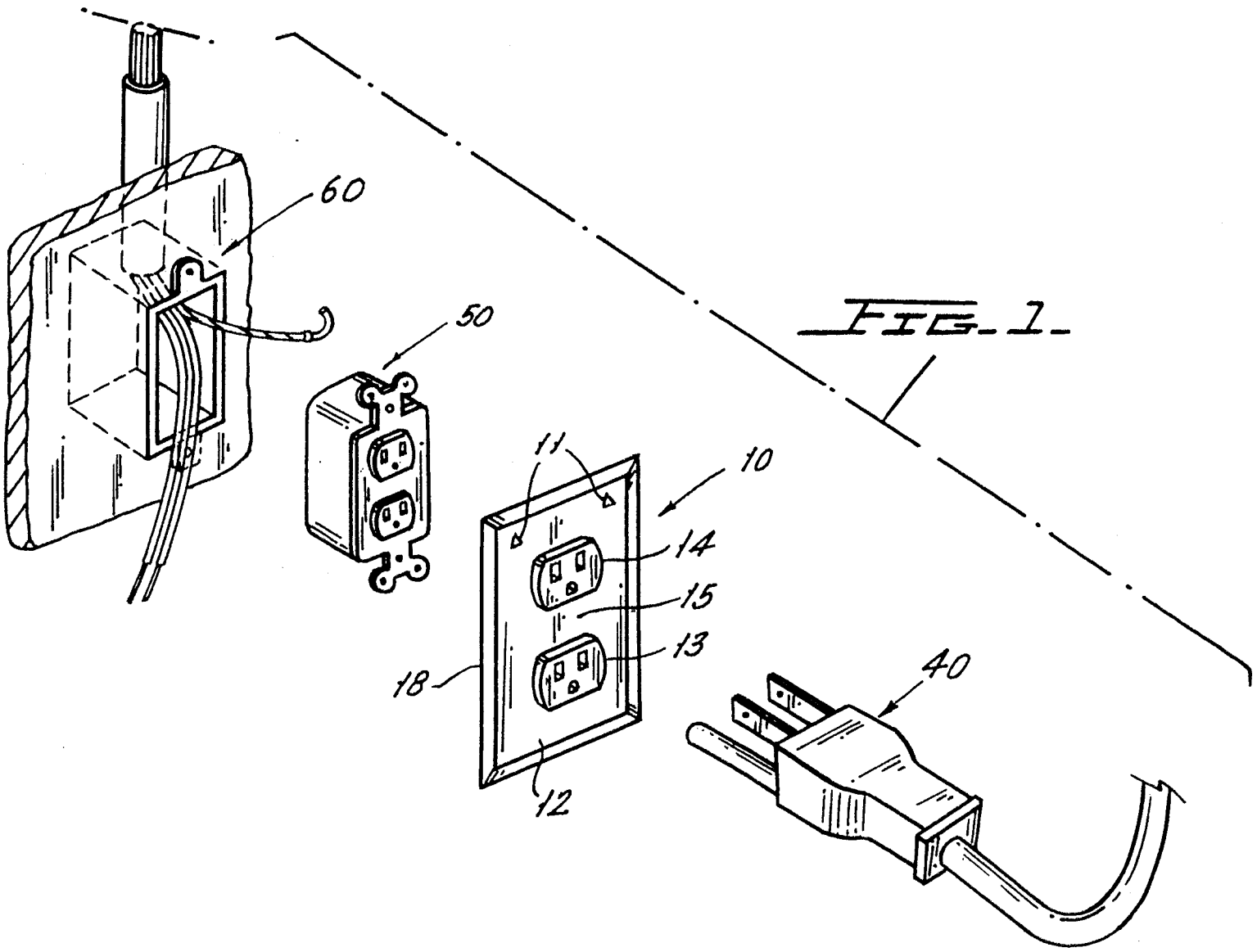
FIG. 1 is a perspective view showing how the receptacle wall plate of the present invention is mounted over a conventional wall outlet.

FIG. 1 shows the receptacle wall plate 10 of the present invention. The wall plate 10 appears just like a conventional wall plate, as it is designed to completely cover the wall outlet box 60 located in the wall 62. Conventional electrical outlet 50 is housed within box 60. The outlet 50 includes receptacle contacts 52 (see FIG. 2) which are engaged by the prongs of the plug 40 of an electrical device.

Wall plate 10 comprises a face plate 12 including apertures 14. For a duplex outlet receptacle, as shown, two sets of conventionally-shaped apertures are provided for the live, neutral and ground prongs of a plug of a device. Unlike a conventional wall plate, the wall plate of the present invention does not have large openings which expose the receptacles of the underlying outlet receptacle, but rather includes individual apertures which correspond to, and appear to be identical to, the apertures of a conventional outlet receptacle.

The wall plate 10 is assembled over electrical outlet 50 by a recessed screw 15. The wall plate also includes LED's 11 which are illuminated when the protection circuitry is activated.

Figure 2:
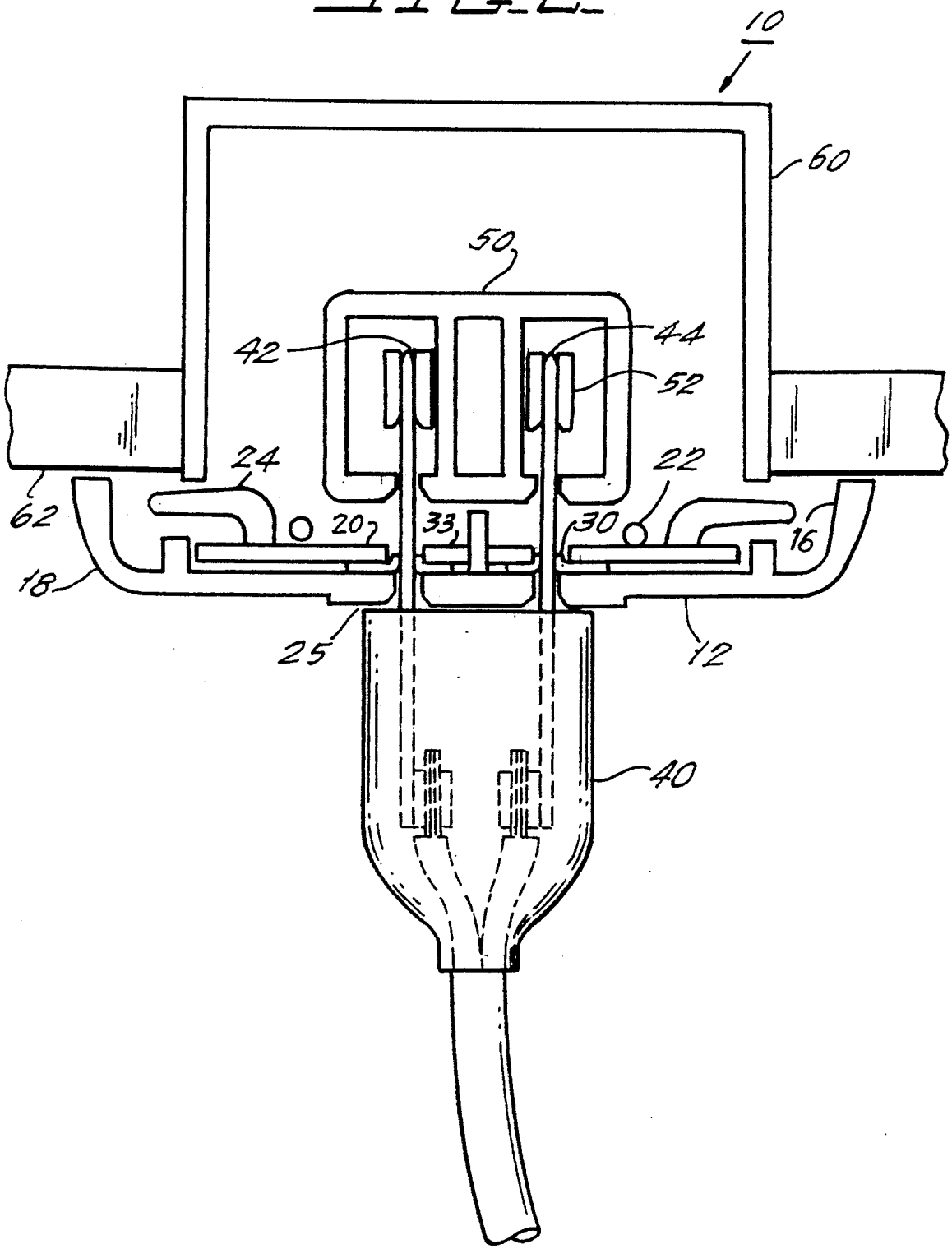
FIG. 2 is a top cross-sectional view of the receptacle wall plate mounted over a conventional wall outlet with a plug of an electrical device inserted therein.

As shown in FIG. 2, the wall plate 10 has an inner surface 16 and rounded edges 18 surrounding the face plate 12 and extending toward wall 62. The face plate and edges form a hollow body.

Disposed in the hollow body is a printed circuit board 20 containing an electrical circuit including varistors 22 to protect the electrical devices from surges in voltage. The use of varistors for surge protection is well known and need not be described further.

Printed circuit board 20 is mounted on the inner surface of face plate 12 with screws (not shown) which extend through face plate 12 to engage tabs 24 extending from circuit board 20.

A plurality of pairs of J-shaped blades 30, electrically connected to the protection circuitry on circuit board 20, extend at least partially across each individual aperture through which the prongs of the plug extend. The blades 30 are physically attached to the printed circuit board 20 via rivets 33. When a plug is inserted into face plate 12, the tips of the live prong 42 and neutral prong 44 engage respective contacts 52 of the outlet box and are connected to the line voltage. Blades 30 supply electricity carried by the prongs of the electrical device to the printed circuit board. Since the electrical current which travels through the surge protection circuitry is much smaller than the load current (normally 15 A), the blades 30 can be thin and flexible, thus providing good contact.

As shown in FIG. 2, the printed circuit board 20 includes apertures 25 which correspond in position to the individual apertures 13 of the face plate 12. Live prong 42 extends through aperture 13 of the face plate, aperture 25 of printed circuit board 20 and through a pair of the blades 30 to engage contacts 52 of the receptacle 50. Likewise, the neutral and ground prongs also extend through the face plate, board 20 and a pair of blades 30 before coupling into receptacle 50. The blades 30 are biased to extend at least partially over apertures 25 to facilitate contact to the prongs of the plug.

Figure 3:
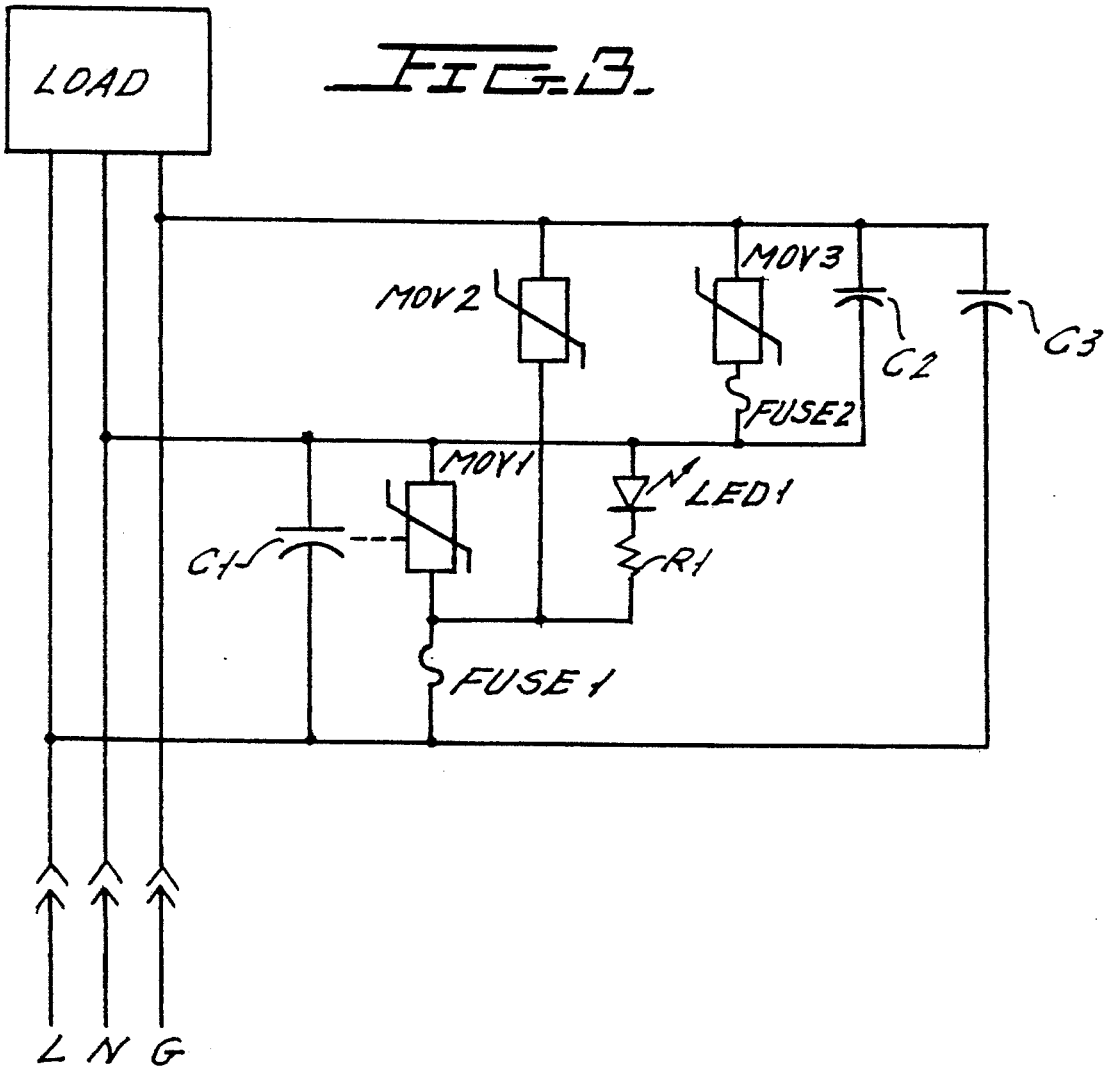
FIG. 3 is a diagram of the surge protection circuitry of the present invention.

FIG. 3 illustrates the preferred surge protection circuitry contained on the printed circuit board 20 and connected in parallel to the source and the load, although any circuit that functions in a parallel manner can be utilized in the present invention. Metal oxide varistors MOV1–MOV3 can have values of, for example, 130 V, 150 V and 130 V. Fuse 1 and fuse 2 preferably have a value of 4 A. The capacitors C1–C3 have the following preferred respective values: 0.022 $\mu$F, 1000 pF and 1000 pF. Resistor R1 is typically 56 K$\Omega$.

Figure 4:
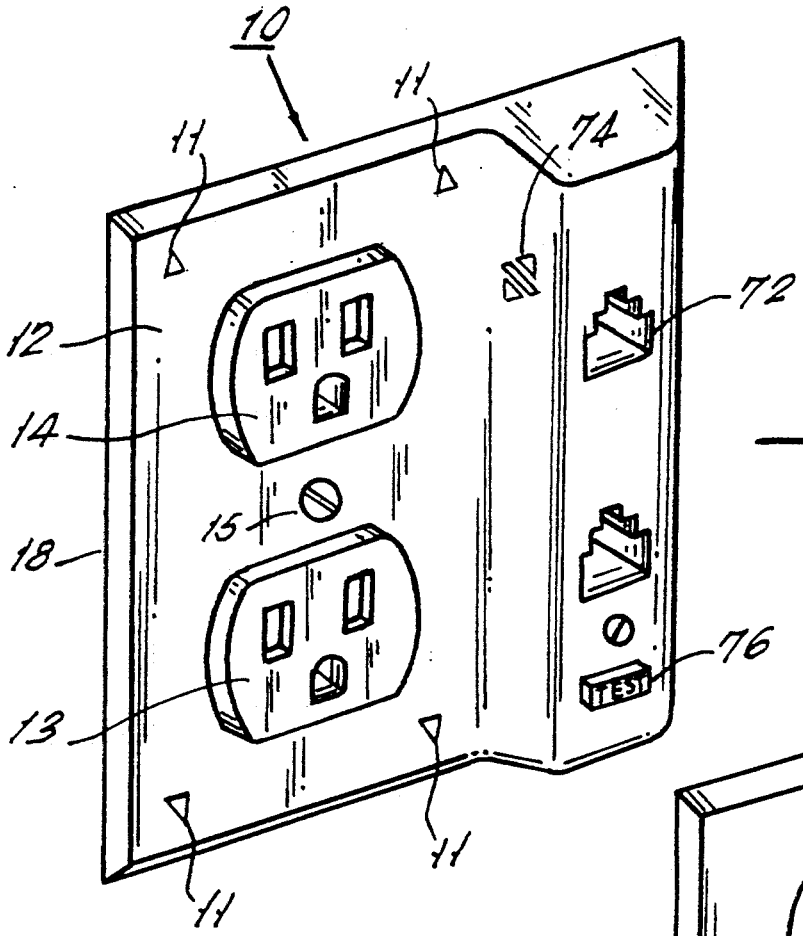
FIG. 4 is a front perspective view of another embodiment of the wall plate of the present invention for protecting secondary devices, such as telephones.
Figure 5:
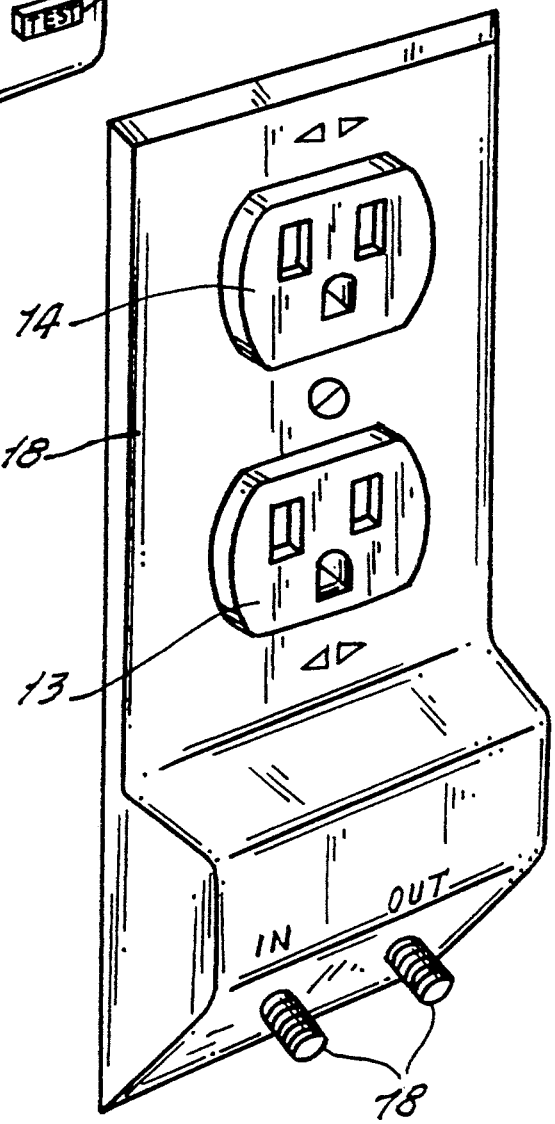
FIG. 5 is a front perspective view of still another embodiment of the wall plate of the present invention, for protecting coaxial devices.

FIGS. 4 and 5 illustrate alternative embodiments of the wall plate of the present invention which also contain circuitry to protect other secondary devices, for example, a phone, fax machine or modem. FIG. 4 illustrates a wall plate having jacks 72 designed to receive, for example, a telephone or fax machine. The electrical circuitry of the printed circuit board 20 is adapted to protect the telephone or fax machine plugged into the jack. The wall plate of FIG. 4 is preferably provided with an audible alarm 74 and a test button 76.

The wall plate of FIG. 5 includes BNC connectors 78 for receiving coaxial cable for protecting a device such as a television or a video player. Like the wall plate of FIG. 4, the circuitry mounted on printed circuit board 20 can be adapted to protect the particular device attached via connectors 78.

Proper grounding must be provided with the embodiments of FIGS. 4 and 5. Grounding can be a prong of the electrical device. Additional space to accommodate the protection circuitry for the secondary devices can be provided along the top, sides or bottom of the wall plate.

Figure 6:
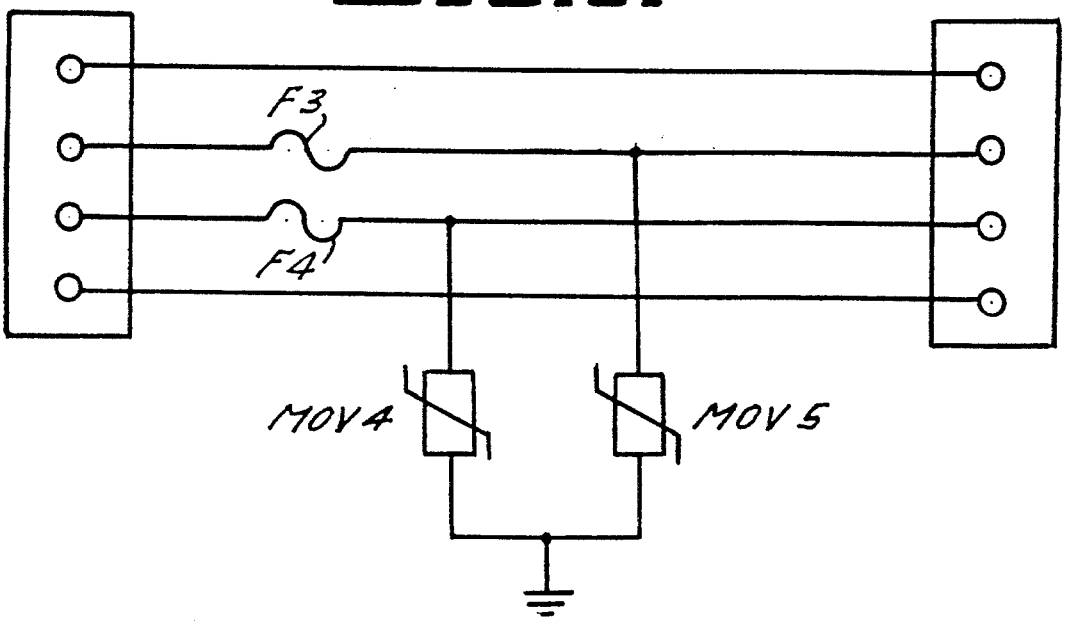
FIG. 6 is a diagram of the surge protection circuitry for the wall plates of FIGS. 4 and 5.

An example of circuitry for protecting secondary devices such as phone, faxes, or modems is shown in FIG. 6, and simply consists of two fuses, F3 and F4, and two varistors MOV4 and MOV5, coupled to ground.

Other indication circuitry, such as a circuit analyzer, a night light, or an equipment theft detection alarm can be incorporated in the wall plate of the present invention.

Although the present invention has been described as providing surge protection, other conditions such as over voltage and over current can be compensated for by utilizing appropriate electrical circuitry on the printed circuit board 20. Thus, many other variations and modifications and other uses will become apparent to those skilled in the art. It is preferred, therefore, that the present invention be limited not by the specific disclosure herein, but only by the appended claims.

What is claimed is:

1. A receptacle wall plate for an electrical outlet having built-in protection means for protecting electrical devices, comprising:

a planar face plate having a plurality of apertures for receiving live, neutral and ground prongs of a plug of an electrical device drawing a load current, said face plate having an inner surface and rounded edges extending toward a surface of a wall on which the wall plate is mounted, said face plate and edges forming a hollow body;

a printed circuit board containing a protection circuit mounted in said hollow body, said protection circuit including means for protecting the electrical devices from surges, said protection circuit drawing a relatively low electrical current as compared to the load current drawn by the electrical device; and means for supplying electricity to said protection circuit when the plug is inserted through said aperture of said face plate comprising a plurality of contact blades mounted on said printed circuit board and extending at least partially over each of said live and neutral apertures, such that when the plug is inserted through said face plate and makes electrical contact with said electrical outlet:

(i) electricity is supplied via the plug to said protection circuit; and (ii) said electrical device is protected;

the live and neutral prongs of said plug, when inserted, being contacted by a pair of said contact blades, said blades being biased against the prongs to facilitate contact therewith, said contact blades being flexible and formed of a relatively thin conductor for carrying the relatively low current drawn by the protection circuit.

2. The receptacle wall plate of claim 1, wherein said face plate includes at least one jack for a secondary device, and said means for protecting said electrical devices includes electrical circuitry for protecting the secondary device plugged into said jack.

3. The receptacle wall plate of claim 1, wherein said face plate includes means for connecting coaxial cables coupled to a secondary device, and said means for protecting said electrical devices includes electrical circuitry for protecting the secondary device coupled to the coaxial cable plugged into said means for connecting coaxial cables.

* * * * *